US007616050B2

(12) United States Patent
Eckstein

(10) Patent No.: US 7,616,050 B2
(45) Date of Patent: Nov. 10, 2009

(54) POWER SUPPLY CIRCUIT FOR PRODUCING A REFERENCE CURRENT WITH A PRESCRIBABLE TEMPERATURE DEPENDENCE

(75) Inventor: Wolfgang Eckstein, Obersulm (DE)

(73) Assignee: Atmel Automotive GmbH, Heilbronn (DE)

( * ) Notice: Subject to any disclaimer, the term of this patent is extended or adjusted under 35 U.S.C. 154(b) by 9 days.

(21) Appl. No.: 11/302,228

(22) Filed: Dec. 14, 2005

(65) Prior Publication Data

US 2006/0125462 A1 Jun. 15, 2006

(30) Foreign Application Priority Data

Dec. 14, 2004 (DE) ..... 10 2004 062 357

(51) Int. Cl.
*H01J 19/82* (2006.01)

(52) U.S. Cl. ..... 327/538; 327/513

(58) Field of Classification Search ..... 323/315, 323/311, 312; 327/66, 132, 490, 538, 513
See application file for complete search history.

(56) References Cited

U.S. PATENT DOCUMENTS

| | | | | |
|---|---|---|---|---|
| 4,602,207 | A | 7/1986 | Kim et al. | |
| 4,808,908 | A * | 2/1989 | Lewis et al. | 323/313 |
| 4,853,646 | A * | 8/1989 | Johnson et al. | 330/256 |
| 5,061,863 | A * | 10/1991 | Mori et al. | 327/50 |
| 5,258,702 | A * | 11/1993 | Conzelmann et al. | 323/313 |
| 5,475,339 | A * | 12/1995 | Maida | 327/561 |
| 6,323,630 | B1 * | 11/2001 | Banba | 323/313 |
| 6,348,832 | B1 * | 2/2002 | Chih | 327/538 |
| 6,351,111 | B1 * | 2/2002 | Laraia | 323/315 |
| 6,445,034 | B1 * | 9/2002 | Moulding et al. | 257/327 |
| 6,836,160 | B2 * | 12/2004 | Li | 327/103 |
| 7,033,072 | B2 * | 4/2006 | Aota et al. | 374/178 |
| 2003/0090314 | A1 * | 5/2003 | Kronmueller et al. | 327/543 |
| 2003/0141920 | A1 * | 7/2003 | Schrodinger et al. | 327/512 |
| 2003/0214277 | A1 | 11/2003 | Reimann | |
| 2005/0068018 | A1 * | 3/2005 | Ho | 323/315 |
| 2005/0196966 | A1 * | 9/2005 | Su et al. | 438/700 |

FOREIGN PATENT DOCUMENTS

| | | |
|---|---|---|
| DE | 196 21 749 A1 | 12/1997 |
| DE | 100 11 669 A1 | 9/2001 |
| DE | 102 22 307 A1 | 12/2003 |
| JP | 2-66613 | 3/1990 |

OTHER PUBLICATIONS

Tietze et al., "*Halbleiterschaltungstechnik*," 10th ed., Berlin, Springer 1993, Fig. 26.20 on p. 900.

* cited by examiner

*Primary Examiner*—Adolf Berhane
*Assistant Examiner*—Nguyen Tran
(74) *Attorney, Agent, or Firm*—Muncy, Geissler, Olds & Lowe, PLLC

(57) ABSTRACT

A power supply circuit is provided for producing a reference current with a prescribable temperature dependence. The circuit includes two current sinks, which at their respective input take up a first input current ($I_1$) or a second input current ($I_2$), and in which current sinks at their respective outputs are connected to a node having a reference potential, the output of at least one current sink being connected via a resistor to the node having the reference potential. The resistor is formed by least two reference resistors with prescribable temperature coefficients that are preferably different from one another.

18 Claims, 3 Drawing Sheets

POWER SUPPLY CIRCUIT FOR PRODUCING A REFERENCE CURRENT WITH A PRESCRIBABLE TEMPERATURE DEPENDENCE

This nonprovisional application claims priority under 35 U.S.C. § 119(a) on German Patent Application No. DE 102004062357, which was filed in Germany on Dec. 14, 2004, and which is herein incorporated by reference.

BACKGROUND OF THE INVENTION

1. Field of the Invention

The present invention relates to a power supply circuit for producing a reference current with a prescribable temperature dependence, the circuit in which two current sinks are provided, which at their respective input take up a first input current or a second input current, and in which the current sinks at their respective output are connected to a node having a reference potential, the output of at least one current sink being connected via a resistor to the node having the reference potential.

2. Description of the Background Art

Power supply circuits are known and are used, for example, in integrated circuits to create internal voltage references with a prescribable or disappearing temperature dependence.

Two current sinks can be made hereby as MOS field-effect transistors, whereby drain currents of the field-effect transistors correspond to the input currents. The field-effect transistors, e.g., because of the different layout of the surface area of their respective gate electrodes are designed in such a way that at identical input or drain currents, different current densities and thereby also different gate-source voltages of the field-effect transistors result, whereby a voltage resulting from the difference of the different gate-source voltages, in addition to an area ratio of the respective gate electrodes, depends on the ambient temperature, among other factors. This temperature-dependent voltage is applied to the resistor that connects an output of a current sink, i.e., a source electrode of the corresponding field-effect transistor, to a node having a reference potential. In this way, the temperature dependence of the current flowing through the resistor can be set with use of the known temperature dependence of the aforementioned voltage and of a resistor with a prescribable temperature coefficient. This current is also designated as the reference current within the meaning of the present invention.

Another circuit that uses bipolar transistors as current sinks is cited, for example, in Tietze, U., Schenk, Ch.: Halbleiterschaltungstechnik (Semi-conductor Technology); $10^{th}$ ed., Berlin, Springer 1993, FIG. 26.20 on page 900.

Moreover, a method for producing an output current with a prescribed temperature coefficient is known from DE 102 22 307 A1, which corresponds to U.S. Publication No. 2003214277, in which currents of two current sinks are added or subtracted from one another and wherein the currents and/or temperature coefficients of the current sinks are different from one another.

It turned out, however, that with these conventional devices, particularly in a realization of the power supply circuit in the form of an integrated circuit, not all possibly desired temperature dependences of the reference current flowing through the resistor can be set. With use of the conventional devices, no reliably operating power supply circuits could be realized, particularly for very small reference currents in the nanoampere range, especially for current strengths of about 20 nA to 50 nA.

SUMMARY OF THE INVENTION

It is therefore an object of the present invention to provide a power supply circuit so that there is greater flexibility in the realization or predefinition of a temperature dependence of a reference current, particularly also for reference currents in the nanoampere range.

This object is achieved in a power supply circuit according to an embodiment of the invention in that a resistor is formed by at least two reference resistors with prescribable temperature coefficients that are preferably different from one another.

The realization, according to the invention, of the resistor through which the reference current flows by at least two reference resistors, which preferably have temperature coefficients different from one another, enables the setting of a desired resulting temperature coefficient for the resistor formed by the reference resistors within a value range formed by the temperature coefficients of the individual reference resistors. The setting of the resulting temperature coefficient in so doing occurs by a suitable weighting, i.e., selection of the resistance values of the reference resistors.

For example, the temperature dependence of the resistance value $R_1$ of the first reference resistor can be described by the following equation:

$$R_1(T)=R_1(T_0)[1+\alpha_1(T-T_0)],$$

where T indicates the absolute temperature, $T_0$ indicates a reference temperature such as, e.g., room temperature, and where $\alpha_1$ indicates the temperature coefficient of the first reference resistor.

Accordingly, the following applies to the temperature dependence of the resistance value $R_2$ of the second reference resistor:

$$R_2(T)=R_2(T_0)\,[1+\alpha_2(T-T_0)],$$

where $\alpha_2$ indicates the temperature coefficient of the second reference resistor.

Overall, in a combination of the invention of these two reference resistors, for example, in the form of a series connection, the following temperature dependence of the resistance values results:

$$R_1(T)+R_2(T)=R_1(T_0)+R_2(T_0)+\alpha_1R_1(T_0)(T-T_0)+\alpha_2R_2(T_0)(T-T_0), \text{ so that}$$

$$R_{1,2}(T)=R_{1,2}(T_0)[1+\alpha_{1,2}(T-T_0)], \text{ with}$$

$$R_{1,2}(T)=R_1(T)+R_2(T)$$

$$R_{1,2}(T_0)=R_1(T_0)+R_2(T_0)$$

$$\alpha_{1,2}=\alpha_1\frac{R_1(T_0)}{R_{1,2}(T_0)}+\alpha_2\frac{R_2(T_0)}{R_{1,2}(T_0)}.$$

It is immediately evident from the preceding equations that several degrees of freedom result by separating the resistance, as taught by the invention, into two reference resistors. On the one hand, the resulting total resistance and thereby the desired reference current at this reference temperature can be set by selecting the appropriate resistance values $R_1(T_0)$, $R_2(T_0)$ at the reference temperature. On the other hand, the temperature coefficients $\alpha_1$, $\alpha_2$ can also be selected to establish the desired temperature dependence.

Here, the resulting temperature coefficient $\alpha_{1,2}$ of the two reference resistors corresponds to a weighted sum of the temperature coefficients $\alpha_1$, $\alpha_2$ of the individual reference resistors, the weighting factors resulting from the resistance values $R_1(T_0)$, $R_2(T_0)$ in each case referred to the total resistance $R_{1,2}(T_0)$.

To produce a temperature-constant reference current through the resistor, the resulting temperature coefficient $\alpha_{1,2}$ of the reference resistors can be set, for example, in such a way that it corresponds to the temperature dependence of the voltage applied at the resistor, so that temperature-determined voltage changes and the corresponding changes in the resistance values of the reference resistors compensate for each other. As a result, the temperature dependence of the reference current thereby disappears.

Furthermore, it is also possible to produce a reference current with a prescribable, non-disappearing temperature dependence with the reference resistors of the invention in that, depending on desired temperature dependence of the reference current, a resulting temperature coefficient, different from the temperature dependence of the voltage applied at the resistor, is set.

A significant advantage of the power supply circuit of the invention is the simple circuit configuration, which requires no control loops and thereby has a low dissipation power and at the same time also a low area consumption with simultaneously great flexibility in regard to the setting of the temperature dependence and the contribution of the reference current.

Another advantage of the embodiment of the power supply circuit of the invention with reference resistors connected in series is that a total resistance of the series connection with a higher resistance value than in the respective reference resistors results. This configuration may be used especially appropriately for setting very small reference currents.

As an alternative hereto, it is also possible, however, to connect several reference resistors in parallel or in the case of more than two reference resistors to provide a combination of series and parallel connections of reference resistors.

According to another embodiment of the present invention, at least one of the reference resistors of the invention can be trimmable, so that e.g., in deviations in the resistance value of the reference resistor due to production tolerances, corrections of the resistance value can be made afterwards. This type of adjustment of the resistance value can occur according to conventional methods, for example, by laser trimming or electron-beam trimming. Further options for adjusting the reference resistors are also provided in form of so-called ZAPP elements, also known from the state of the art, in the form of zener diodes, which are selectively fused to set certain resistance values and thereby become conductive and in this manner bridge special trim resistors.

In another embodiment of the power supply circuit of the invention, at least one of the reference resistors is made as a film resistor, so that the reference resistor can be provided directly as a component of an integrated circuit.

In another embodiment of the present invention, the resistance values and/or the temperature coefficients of the reference resistors can be selected as a function of the temperature coefficients of the power supply circuit components. The temperature dependences of other components, optionally provided in the power supply circuit, can thereby also be considered—in addition to the voltage applied at the resistor—and their effect on the temperature dependence of the reference current can be compensated.

In another embodiment of the power supply circuit of the invention, the temperature coefficients $\alpha_1$, $\alpha_2$ have a different sign, i.e., $\alpha_1\ \alpha_2<0$, so that with use of the condition $$\alpha_{1,2} = \frac{R_1(T_0)}{R_{1,2}(T_0)}\alpha_1 + \frac{R_2(T_0)}{R_{1,2}(T_0)}\alpha_2 = 0$$

it is also possible to realize a resistor with a temperature-dependent resistance value.

Apart from modeling of the temperature dependence—as described above—by a linear association between the resistance value and the temperature, in the combination of the invention of several reference resistors, terms of a higher order can also be considered, for example, to better approximate an actual nonlinear temperature dependence. To that end, for example, a quadratic term with a additional temperature coefficient $\beta_1$ can be used, so that, e.g., the following temperature dependence results for an individual reference resistor:

$$R(T)=R(T_0)\ [1+\alpha_1(T-T_0)+\beta_1(T-T_0)^2].$$

The current sinks in another embodiment of the present invention can be field-effect transistors or bipolar transistors. Hereby, a realization of the power supply circuit of the invention is possible both with the use of N-channel or P-channel field-effect transistors and also with use of NPN- or PNP-bipolar transistors.

Another embodiment of the invention provides that the power supply circuit can be made at least partially as an integrated circuit.

According to another advantageous embodiment of the present invention, a current mirror circuit can be provided to supply the current sinks with the first input current or the second input current, whereby the first input current is in a prescribable proportionality ratio to the second input current. Preferably, the input currents of the two current sinks for use in the power supply circuit of the invention are selected as equal in size, which results in a simpler circuit configuration particularly in the current mirror circuit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein the figure shows an embodiment of the power supply circuit of the invention, in which two current sinks Q1, Q2 made as field-effect transistors are provided.

DETAILED DESCRIPTION

Figure 1:
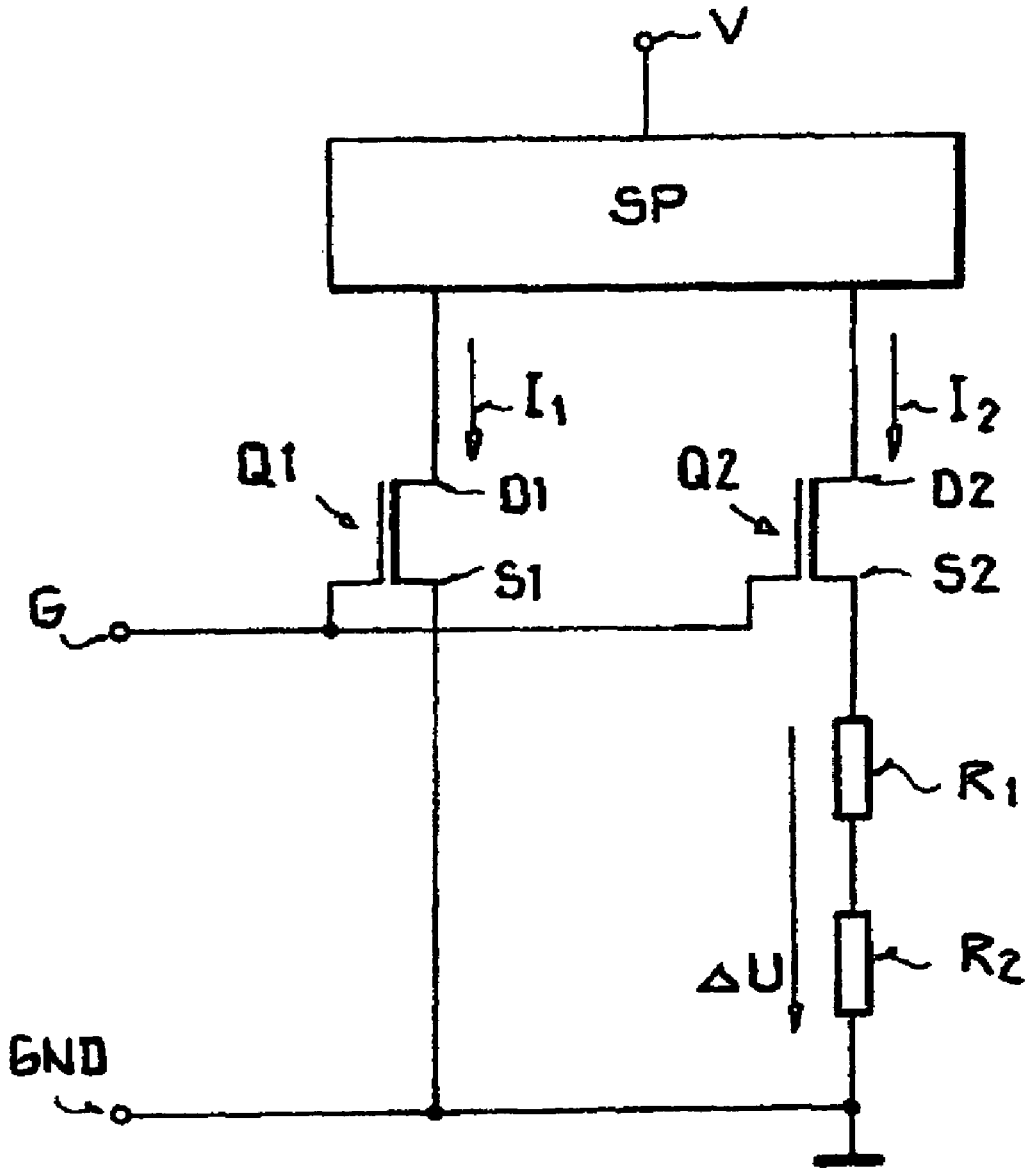
FIG. 1 is an exemplary embodiment of a power supply circuit, according to the invention.
Figure 2:
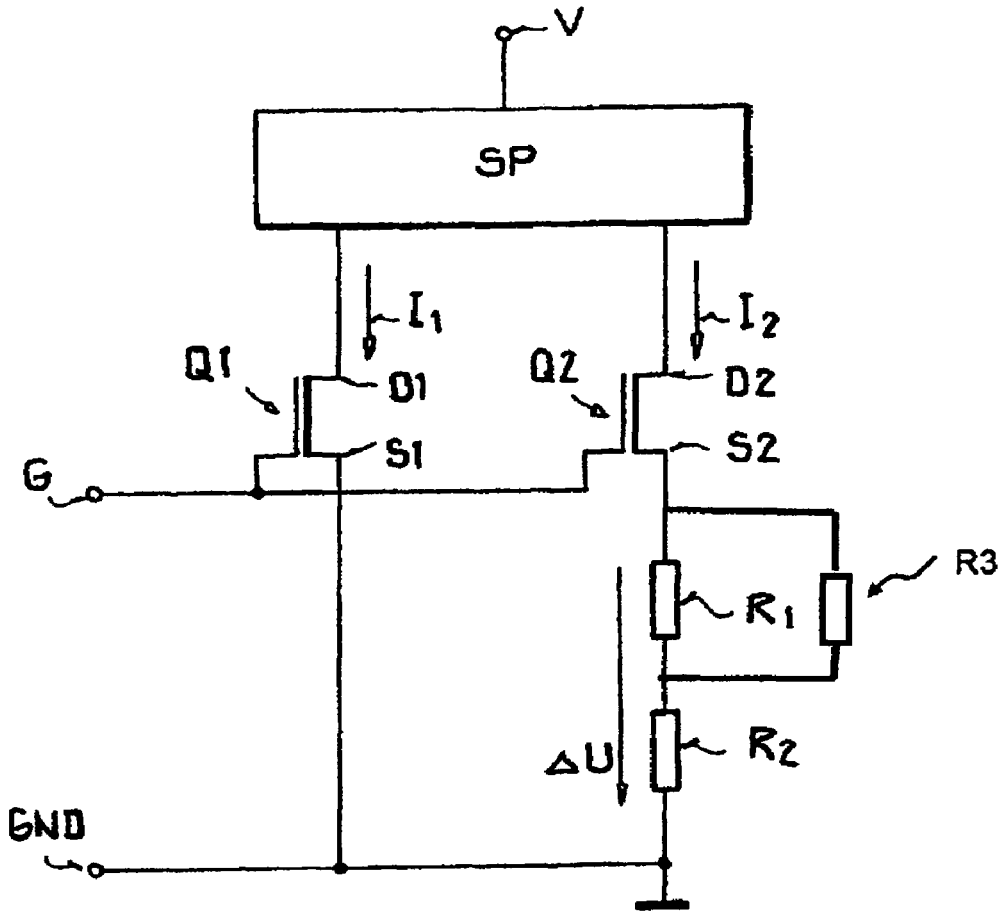
FIG. 2 is another exemplary embodiment of a power supply circuit, according to the invention.
Figure 3:
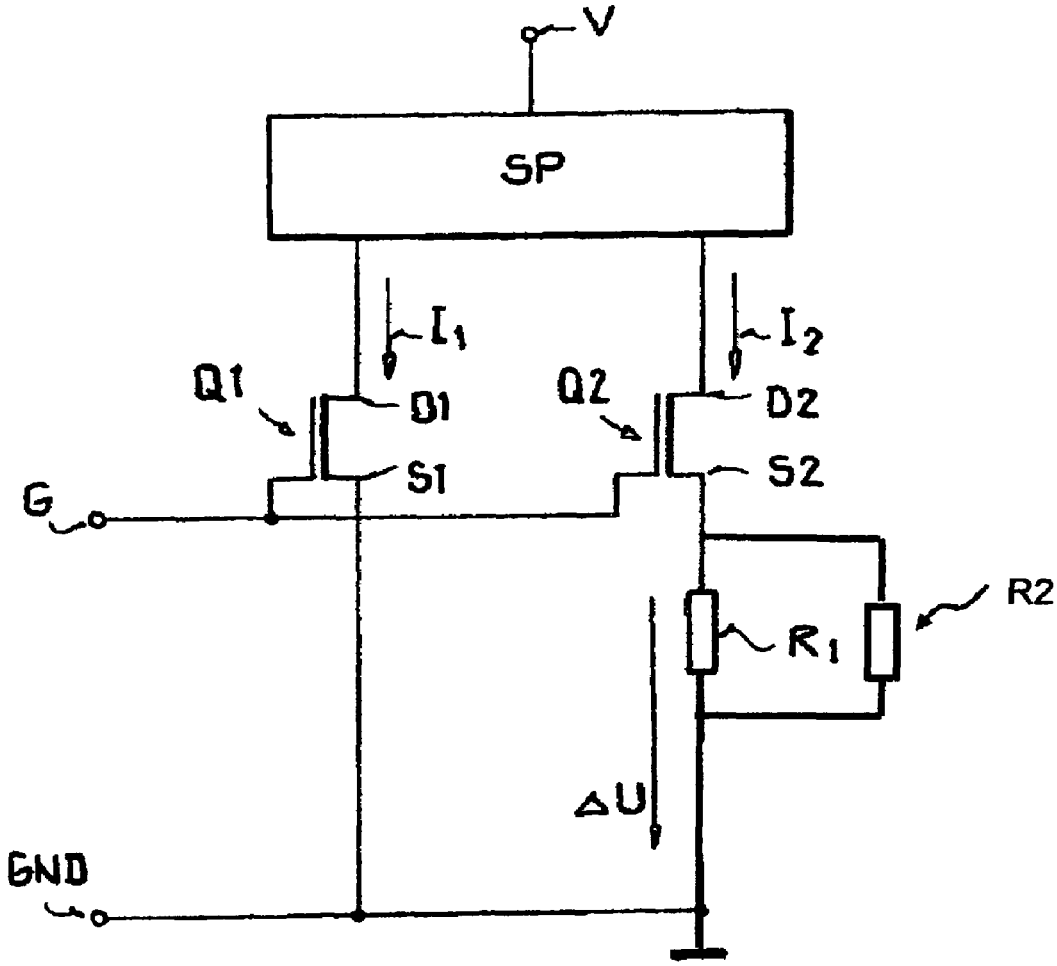
FIG. 3 is another exemplary embodiment of a power supply circuit, according to the invention.

Drain electrodes D1, D2 of the field-effect transistors Q1, Q2 form inputs D1, D2 and are each connected to a current mirror circuit SP, which in turn is connected to a supply voltage via electrode V, shown at the top in FIG. 1.

A source electrode S1 as the output of the first field-effect transistor Q1 is connected directly to a node GND, which has the ground potential as a common reference potential for the power supply circuit of the invention. A source electrode S2 as the output of the second field-effect transistor Q2 is connected to the node GND via two reference resistors $R_1$, $R_2$ connected in series.

Furthermore, gate electrodes of the two field-effect transistors Q1, Q2 are connected to one another and thus form a common gate connection G.

To produce the input current $I_2$, also designated as the reference current, the common gate connection G of the initially blocking field-effect transistors Q1, Q2 of a control circuit, not shown in FIG. 1, is acted upon with a starting pulse, so that the input current $I_2$ results as a drain current across the second field-effect transistor Q2.

The current mirror circuit SP thereupon supplies the drain electrode D1 of the first field-effect transistor Q1 with the input current $I_1$, which has a prescribable proportional ratio to the input current $I_2$. In the present example, the current mirror circuit SP is made in such a way that the input current $I_1$ of the first field-effect transistor Q1 corresponds to the input current $I_2$ of the second field-effect transistor Q2, i.e., $I_1=I_2$.

The field-effect transistors Q1, Q2 are made in such a way that different current densities result in the field-effect transistors Q1, Q2 at same drain currents or input currents $I_1$, $I_2$; this leads in a known manner to different gate-source voltages, so that an inter alia temperature-dependent voltage of approximately $$\Delta U \cong \frac{kT}{q}\ln\left(\frac{A_2}{A_1}\right)$$

results across the reference resistors $R_1$, $R_2$ of the invention, where k is the Boltzmann's constant, where T is the absolute temperature, where q is the elementary charge, and where $A_1$ or $A_2$ is the area of the respective gate electrode of the field-effect transistors Q1, Q2.

The following holds for the contribution of the reference current $I_2$ with disregard of a voltage drop across the drain-source section of the field-effect transistor Q2:

$$I_2 = \frac{\Delta U}{R_1 + R_2}.$$

To set a desired contribution $I_{ref}$ for the reference current, accordingly—proceeding from a known voltage, e.g., at the reference temperature $T_0$—the reference resistors $R_1$, $R_2$ are to be selected first such that $$R_{1,2}(T_0) = \frac{\Delta U(T_0)}{I_{ref}}, \text{ where}$$

$$R_{1,2}(T_0) = R_1(T_0) + R_2(T_0).$$

In other words, the sum $R_{1,2}(T_0)$ of the resistance value at the reference temperature is selected so that the desired reference current arises. According to the invention, hereby a degree of freedom results compared with conventional power supply circuits, because to set the contribution $I_{ref}$ of the reference current it is immaterial how large the individual resistance values of the reference resistors are in each case, as long as their sum $R_{1,2}(T_0)$ has the necessary value.

Assuming a linear temperature dependence of the two reference resistors $R_1$, $R_2$, i.e., with $$R_1(T)=R_1(T_0)[1+\alpha_1(T-T_0)],$$

$$R_2(T)=R_2(T_0)\,[1+\alpha_2(T-T_0)],$$

where T indicates the absolute temperature, $T_0$ represents the described reference temperature, and where $\alpha_1$ indicates the temperature coefficient of the first reference resistor, and $\alpha_2$ indicates the temperature coefficient of the second reference resistor, the following applies to the total resistance formed from the two reference resistors $R_1$, $R_2$:

$$R_1(T)+R_2(T)=R_1(T_0)+R_2(T_0)+\alpha_1 R_1(T_0)(T-T_0)+\alpha_2 R_2(T_0)(T-T_0), \text{ so that}$$

$$R_{1,2}(T)=R_{1,2}(T_0)[1+\alpha_{1,2}(T-T_0)], \text{ with}$$

$$R_{1,2}(T)=R_1(T)+R_2(T)$$

$$R_{1,2}(T_0)=R_1(T_0)+R_2(T_0)$$

$$\alpha_{1,2} = \alpha_1\frac{R_1(T_0)}{R_{1,2}(T_0)} + \alpha_2\frac{R_2(T_0)}{R_{1,2}(T_0)}.$$

It is evident herefrom that $\alpha_{1,2}$ can be regarded as the resulting temperature coefficient for the total resistance $R_{1,2}$ (T) formed from the reference resistors $R_1$, $R_2$.

With use of the equation $$\alpha_{1,2} = \alpha_1\frac{R_1(T_0)}{R_{1,2}(T_0)} + \alpha_2\frac{R_2(T_0)}{R_{1,2}(T_0)} = \alpha_{soll}$$

$$(soll = \text{target}),$$

finally the temperature coefficients $\alpha_1$, $\alpha_2$ and their weighting factors $$\frac{R_1(T_0)}{R_{1,2}(T_0)}, \frac{R_2(T_0)}{R_{1,2}(T_0)}$$

are still to be determined to obtain a desired value $\alpha_{target}$ for the resulting temperature coefficients $\alpha_{1,2}$.

The temperature coefficients $\alpha_1$, $\alpha_2$ of the reference resistors are hereby advantageously selected in such a way that they each correspond to a minimum or maximum desired resulting temperature coefficient $\alpha_{1,2min}$, or $\alpha_{1,2max}$. In this manner, by selecting suitable weighting factors, it is possible to achieve any resulting temperature coefficient $\alpha_{1,2}$ from the interval ($\alpha_{1,2min}$, $\alpha_{1,2max}$).

The possibility of selecting temperature coefficients $\alpha_1$, $\alpha_2$ with different signs is also especially advantageous in the combination of the invention of the reference resistors, so that a resistor with a disappearing temperature dependence is realizable. In this case, the following applies:

$$\alpha_{1,2} = \alpha_1 \frac{R_1(T_0)}{R_{1,2}(T_0)} + \alpha_2 \frac{R_2(T_0)}{R_{1,2}(T_0)} = 0, \text{ i.e.,}$$

$$\frac{\alpha_1}{\alpha_2} = -\frac{R_2(T_0)}{R_1(T_0)}.$$

According to an especially advantageous embodiment of the present invention, the power supply circuit is made at least partially as an integrated circuit. The reference resistors $R_1$, $R_2$ are preferably made as film resistors and designed as trimmable to correct variations in their resistance values, due to production technology. Adjustment of the resistance values, for example, occurs by laser trimming or electron-beam trimming or be made possible by providing one or more corresponding resistance networks; here, individual resistors of the resistor network are selectively bridgeable, e.g., by the use of ZAPP elements or the like.

It is possible, furthermore, to design the power supply circuit, e.g., with one of the two reference resistors in the form of an integrated circuit and to provide the other reference resistor in a discrete circuit, so that a subsequent exchange of the discretely made reference resistor is possible and the appropriate resistance value and its temperature coefficient can be changed in this way.

Instead of the ground potential, another common reference potential may also be selected, which is advantageously, for example, between the ground potential and a potential that corresponds to a supply voltage.

According to another embodiment of the present invention, the two current sinks Q1, Q2 are made as P-channel MOS field-effect transistors. In this case as well, a common gate connection of the P-channel MOS field-effect transistors is provided. In contrast to the exemplary embodiment of FIG. 1, however, drain electrodes of the P-channel MOS field-effect transistors are each connected to an appropriate current mirror circuit, which in turn is connected, for example, to a node, which has a ground potential, via an electrode provided for this purpose. A source electrode of one of the two P-channel MOS field-effect transistors in this circuit variant is connected directly to a node having a common reference potential, whereas a source electrode of the other P-channel MOS field-effect transistor is connected to said node via the reference resistors $R_1$, $R_2$ of the invention.

In another embodiment of the present invention, the current sinks Q1, Q2 are made as NPN or also as PNP bipolar transistors, whereby the temperature-dependent voltage $\Delta U$ is obtained in a known manner, e.g., by bipolar transistor emitter areas different in size.

Overall, by the combination of the invention of reference resistors, a power supply circuit is realizable, which enables reliable production of reference currents in the nanoampere range and which at low circuit effort simultaneously enables great flexibility with respect to the setting of the temperature dependence of the reference current. Tests by the present applicant have shown that the described power supply circuit enables the production of reference currents with a defined temperature dependence also at current strengths below 10 nA.

Another advantage of the power supply circuit of the invention is the low dissipation power of less than 500 nW at conventional supply voltages. Moreover, the power supply circuit of the invention requires no control loops to set the reference current; this results in a lower area consumption for the entire power supply circuit, particularly in a design of the power supply circuit as an integrated circuit.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A power supply circuit for producing a reference current with a prescribable temperature dependence, the power supply circuit comprising:

a current mirror outputting a first current and a second current;

a resistor formed by at least two reference resistors having prescribable temperature coefficients that are different from one another; and two current sinks, each current sink having a terminal of a different size from the other sink, which at their respective input receive the first current or the second current, and in which the current sinks at their respective outputs are connected to a node having a reference potential, the output of at least one current sink being connected via the resistor to the node having the reference potential, wherein a voltage across said resistor is a temperature dependent voltage which has a known value at a reference temperature which known value is proportional to the respective different sizes of each of the terminals of said current sinks wherein the total resistance of said resistor is set to a value at said reference temperature to produce said reference current.

2. The power supply circuit according to claim 1, wherein the reference resistors are connected to one another in series.

3. The power supply circuit according to claim 1, wherein at least one of the reference resistors is trimmable.

4. The power supply circuit according to claim 1, wherein at least one of the reference resistors is a film resistor.

5. The power supply circuit according to claim 1, wherein the temperature coefficients of the reference resistors have a different sign.

6. The power supply circuit according to claim 1, wherein the current sinks are field-effect transistors or bipolar transistors and wherein said respective area are gates of said field-effect transistors or emitters areas of said bipolar transistors.

7. The power supply circuit according to claim 1, wherein the power supply circuit is an integrated circuit.

8. The power supply circuit according to claim 1, wherein the resistor is formed by more than two reference resistors having prescribable temperature coefficients, and wherein the reference resistors are connected to one another in a combination of series and parallel connections.

9. The power supply circuit according to claim 1, wherein the reference resistors are connected to one another in parallel.

10. The power supply circuit according to claim 1, wherein the first input current is equal to the second input current.

11. The power supply circuit according to claim 1, wherein the output of at least one current sink is connected directly to the node having the reference potential.

12. A power supply circuit for producing a reference current with a prescribable temperature dependence, the power supply circuit comprising:

a first transistor having a terminal area of a first size and having an output, a drain input receiving a first current, and a gate input;

a second transistor having a terminal area of a second size different from said first size and having an output, a drain input receiving a second current, and a gate input; and a resistor formed by at least two reference resistors having prescribable temperature coefficients that are different from one another;

said first transistor output and said second transistor output being connected to a reference potential, the output of said second transistor being connected to the reference potential via the resistor wherein a temperature dependent voltage across said resistor has a known value at a reference temperature which is proportional to the respective different sizes of each of the terminals of said first and second transistors and wherein the total resistance of said resistor is set to a value at said reference temperature to produce said reference current.

13. The power supply circuit of claim 12 wherein the first resistor has a temperature coefficient having a first sign and the second resistor has a temperature coefficient having a second sign opposite to said first sign.

14. A method of forming a power supply circuit for producing a reference current with a prescribable temperature dependence comprising the steps of:

providing first and second current sinks each having an input and an output said first current sink having a terminal with an area different in size than a corresponding terminal of said second current sink;

providing at least two reference resistors having prescribable temperature coefficients, the prescribable temperature coefficients being different from one another and being selected as a function of the temperature coefficients of power supply circuit components and wherein a voltage across said at least two reference resistors is a temperature dependent voltage which has a known value at a reference temperature which known value is proportional to the respective different sizes of each of the terminals of said current sinks;

connecting the at least two reference resistors in series or parallel to form a control resistor;

providing a first current to the first current sink input;

providing a second current to the second current sink input;

connecting the first current sink output to a reference potential;

connecting the second current sink output to the reference potential via the control resistor;

setting the total resistance of said control resistor to a value corresponding to said reference temperature in order to produce said reference current.

15. The power supply circuit according to claim 1, wherein each current sink of the two current sinks is a transistor whose control inputs are connected to one another.

16. The power supply circuit according to claim 1 wherein a temperature coefficient of the reference resistors is a function of said temperature dependence of said temperature dependent voltage.

17. The power supply circuit according to claim 12 wherein a temperature coefficient of the reference resistors is a function of said temperature dependence of said temperature dependent voltage.

18. The method according to claim 14 further including providing a temperature coefficient of the reference resistors which is a function of said temperature dependence of said temperature dependent voltage.

* * * * *